United States Patent [19]

Munz et al.

[11] Patent Number: 5,044,623

[45] Date of Patent: Sep. 3, 1991

[54] APPARATUS FOR STACKING SHEETS

[75] Inventors: Rolf Munz, Kernen; Claus Weber, Ostfildern, both of Fed. Rep. of Germany

[73] Assignee: Eastman Kodak Company, Rochester, N.Y.

[21] Appl. No.: 437,007

[22] Filed: Nov. 15, 1989

[30] Foreign Application Priority Data

Nov. 21, 1988 [DE] Fed. Rep. of Germany ..... 3839304

[51] Int. Cl.[5] ..... B65H 31/20

[52] U.S. Cl. ..... 271/223; 271/200; 271/220; 271/224

[58] Field of Search ..... 271/161, 171, 188, 198, 271/200, 207, 209, 223, 264, 224, 3.1, 171, 220

[56] References Cited

U.S. PATENT DOCUMENTS

| | | | |
|---|---|---|---|
| 2,963,177 | 12/1960 | Shields | 271/198 |
| 3,682,473 | 8/1972 | Kuyt | 271/3.1 |
| 3,814,000 | 6/1974 | Heisler | 271/3.1 |
| 4,002,249 | 1/1977 | Shinomiya et al. | 271/200 |

FOREIGN PATENT DOCUMENTS

| | | | |
|---|---|---|---|
| 237621 | 10/1959 | Australia | 271/224 |

*Primary Examiner*—David H. Bollinger
*Assistant Examiner*—Steven Kennemore
*Attorney, Agent, or Firm*—Lawrence P. Kessler

[57] ABSTRACT

Apparatus for stacking sheets comprises a collecting bin with a front stationary abutment and a rear limiting element adjustable to various sheet size ranges. A first deflecting roller, adjustable in the entrance direction of the sheets and mounted on a rear limiting element, provides support for a transport belt transporting the sheets. The rear limiting element is mounted on a support which is movable in the entrance direction by means of two parallel threaded spindles rotatable by a stepping motor. A second deflecting roller which is associated with the outer side of the transport belt facing the sheet stack is arranged on the support, whereas the first deflecting roller is located on the inner side of the transport belt. Adjacent to the second deflecting roller, a stationary deflecting roller is arranged such that the transport belt is guided along an S-shaped path. When the support is adjusted in the entrance direction, the first and second deflecting rollers are moved by equal distances so that the guide length of the transport belt remains constant at all times.

12 Claims, 1 Drawing Sheet

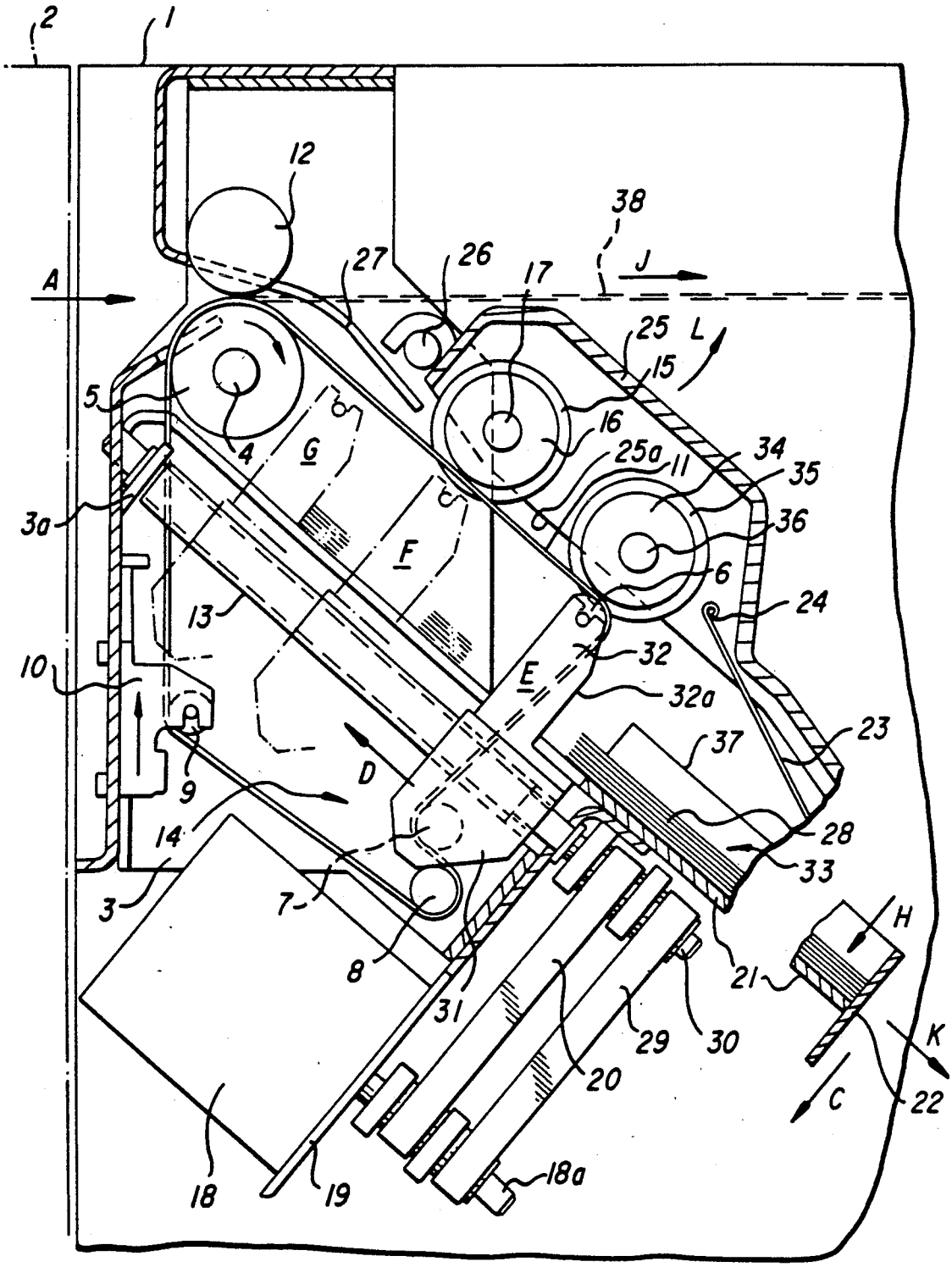
2
1
12
38
J
A
27
26
17
25
L
15
5
16
4
G
25a
11
34
35
3a
36
F
6
24
13
32
10
E
32a
23
37
D
9
28
14
33
3
7
H
8
21
31
29
30
K
20
C
22
18
19
18a

APPARATUS FOR STACKING SHEETS

BACKGROUND OF THE INVENTION

This invention relates to apparatus for stacking sheets, in particular sheets fed seriatem along a path, in a collecting bin which is adjustable in the entrance direction to different sheet sizes such that a stationary abutment associated with all sheet sizes is provided for the lead sheet edge, seen in the entrance direction, and an adjustable limiting element is associated with the trailing sheet edge, the sheets being stacked in the collecting bin from the edge of the stack which is adjacent to said adjustable limiting element.

In a sheet stacking apparatus such as disclosed in DE-PS 33 15 708, the sheets are stacked on a tray, against a lead edge stop, passing over an adjustable sheet size limiting element. In the area of the trailing edge of the stack, the trailing edge guide for the incoming sheets can approach the lead edge stop of the stack only as far as this is allowed by the maximum sheet size to be stacked. However, when an adjustment of the guide has to be made to the minimum sheet size, the distance between the lead edge stop and the trailing edge guide is so great that, in the absence of adequate guidance, the lead edge of an incoming sheet can hit the trailing edge of the stack or can get under sheets already located in the sheet stack, which may lead to malfunctioning and an incorrect stacking order.

It is also known (U.S. Pat. No. 4,129,295) for sheets being stacked in a collecting bin to be transported through an upwardly inclined guide toward the collecting bin and to be guided into contact with a concave cover which is arranged above the collecting bin. Incoming sheets are thus guided in an arc to a position above the sheet stack and directed onto the stack such that the incoming sheets cannot hit upwardly pointing sheet ends at the trailing edge of the sheets already deposited. However, the arcuate guide path provided for the sheets in this known device requires a great amount of space.

SUMMARY OF THE INVENTION

It is an object of the invention to provide a collecting bin for sheet stacking such that when sheet size adjustments are made, the sheets are always deposited free from disturbances while a spacesaving construction is achieved at the same time. According to this invention this object is attained by an endless transport belt for transporting the sheets into the collecting bin arranged in the entrance area of the collecting bin, such belt extending approximately parallel with the upper side of the stack and being arranged above the maximum stack height in the area where the sheets are fed into the collecting bin, the transport belt being deflected about a first deflecting roller mounted so as to be adjustable in the entrance direction such that the deflected section of the transport belt forms the adjustable rear limiting element of the collecting bin, and a second deflecting roller adjustable together with the first deflecting roller arranged below the collecting bin so as to face the sheet stack.

Advantageously the first and second deflecting rollers are rotatably mounted on a support adjustable in the entrance direction, such support being adjustable by a motor via worm-gear spindles in the entrance direction to predefined positions associated with sheet size ranges. The transport belt, consisting of a plurality of endless belts, is deflected in the area of the second deflecting roller arranged below the collecting bin about a further stationary deflecting roller in an S-shaped configuration such that the support along with the first and second deflecting rollers arranged thereon can be adjusted and thus the size of the collecting bin changed without any change in the length of the endless belts. The collecting bin and the transport belt located in its entrance area are downwardly inclined in the entrance direction. This is advantageous in that free space is provided for accommodating for further transport so that, in addition to the sheet collecting function, the sheets may also be further transported, for example, into downstream processing devices. Moreover, as a result of the advantageous inclination of the collecting bin and transport belt, the outer dimensions of the apparatus may be reduced in the direction in which the sheets are introduced. Further, the deflecting rollers which deflect the transport belt downwardly out of the entrance direction are associated with counter rollers and stiffening rollers which are disposed opposite to the deflecting rollers in the predefined adjustment positions and ensure that the sheets are stacked functionally correct and free from disturbances.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

The FIG. shows schematically a lateral and partially sectional view of the sheet stacking apparatus according to this invention.

DESCRIPTION OF THE PREFERRED EMBODIMENT

Referring now to the accompanying drawing, the sheet stacking apparatus according to the invention is arranged in a housing 1 which is connected, for example, to any known type of reproduction device 2, shown in dash-dotted lines, such that sheets delivered by the reproduction device in the direction of the arrow "A" are directly transported to the transport device 5, 11, 12 of the sheet stacking apparatus. The elements of the sheet stacking apparatus are arranged in an inclined position such that, starting from the direction of the arrow "A", a downwardly inclined transport path and collecting bin 33 mounted on a support 3 secured to housing 1 is obtained. The transport mechanism for feeding in the sheets delivered by the reproduction device 2 consists of a transport roller 5 and deflecting rollers 6, 7, 8 and 9 which serve to guide a plurality of endless belts 11, for example, four belts arranged at a distance from and parallel with each other in the transport direction "A". The endless belts 11 are driven by the transport roller 5 which is driven clockwise via a stationarily mounted shaft 4 by a motor (not illustrated). The lower deflecting rollers 8 and 9 are also stationary, deflecting roller 9 being composed of individual deflecting roller elements, each associated with an endless belt and arranged on separately adjustable mounting portions 10 for tensioning the belts.

The deflecting rollers 6 and 7 are mounted on a support 14 extending perpendicularly to the sheet transport direction and adjustable in the direction of the arrow "D". The support 14 consists of two guide members 31 with internal threads, such guide members being guided on two spaced parallel worm-gear spindles 13 and 30 for movement in the direction of the arrow "D". The guide members 31 are each provided with square bolts facing each other (not illustrated) onto which is plugged a square tube which rigidly connects the two guide members 31. The deflecting rollers 6 arranged between the two guide members 31 are rotatably mounted on mounting elements 32 on the square tube. The plurality of deflecting rollers 6 with their mounting elements 32 are associated with the plurality of endless belts 11, respectively.

Deflecting roller 7 takes the form of an uninterrupted shaft which is mounted at its ends for rotation on the two guide members 31. The spindles 13 and 30 are mounted at their ends in mounting portions 3*a* and a mounting plate 19 respectively and are made to rotate by belts 20 and 29 respectively which are driven by a motor shaft 18*a* of a stepping motor 18. Belt 29 is associated with the second spindle 30 (invisible in the drawing, as it lies behind the first spindle 13).

In an area of support 14 and the lower deflecting roller 8 the endless belt assembly is guided such that the belts 11 are downwardly deflected out of their downwardly inclined transport direction about the adjustable deflecting roller 6 and subsequently guided about the adjustable deflecting roller 7 in an S-shaped configuration toward the front and about the lower stationary deflecting roller 8. As a result of this special guiding of the endless belts 11, the deflecting roller 6 associated with the inner surface of the endless belts 11, and the roller 7 associated with the outer surface of the endless belts 11 are adjusted simultaneously by equal amounts when support 14 is adjusted in the direction of the arrow "D". Consequently the lengths of the endless belts 11 remain constant in each of the adjustment positions "E", "F" and "G" to be described further below.

The mounting portions 32 of support 14 have end faces 32*a* which face a collecting bin 33 and form a rear adjustable limiting element of the collecting bin 33. The end faces 32*a* are arranged perpendicular to a downwardly inclined support surface 21 of the collecting bin 33. The front limiting element of collecting bin 33 which is located opposite to the rear limiting element formed by end faces 32*a* is formed by an abutment 22 which is stationary with respect to the sheet transport direction while being electromagnetically movable in the direction of the arrow "C". In the area adjacent to abutment 22, a stapling device of any known type (not illustrated), for example, is arranged. The stapling device can staple a sheet stack 28 located in the collecting bin 33 in the direction indicated by arrow "H".

Above drive roller 5, spring-urged, rotary pressure rollers 12 are arranged which are associated with the individual endless belts 11. In this area, directing elements 27 are also arranged which extend between the pressure rollers 12 and serve to direct and deflect the sheets arriving in the direction of the arrow "A". Freewheeling counter rollers 16 and 34 as well as stiffening rollers 15 and 35 of a larger diameter, which extend between the endless belts 11, are mounted parallel with the endless belts 11 and are associated therewith. The counter rollers 16 and 34 respectively and the stiffening rollers 15 and 35 respectively are each jointly mounted for rotation on shafts 17 and 36 respectively arranged parallel with the deflecting rollers 6 and mounted on a cover 25, with the shafts 17 and 36 respectively being coupled by an endless belt (not illustrated). The mounting shafts 17 and 36 respectively of rollers 15, 16 and 34, 35 respectively are placed such that they are associated with the positions "E" and "F" respectively in relation to the direction of movement of support 14. As a result, the sheets to be stacked are reliably guided directly up to the position where they are to be delivered ("E" and "F" respectively). A third position "G" of support 14 is located very closely to the drive roller 5 situated on the entrance side and to the counter rollers 12 and is directly adjacent to the directing elements 27 so that a reliable guiding of the sheets is ensured in this case as well. The three selectable positions "E", "F" and "G" of support 14 are associated with three standard sheet size ranges such as, for example, B5, 8"×9" and B4.

In the illustrated embodiment of the sheet stacking apparatus, the sheet sizes are particularly associated with the various positions such that in the adjustment position "G", for example, only size B4 is deposited so that the end face 32*a* of mounting portion 32 (rear limiting element) is arranged very closely to the rear end size of sheet stack 28. As a result, an incoming B4 size sheet moves in all cases onto sheet stack 28 without any disturbances. In the adjustment positions "F" and "E" the end face 32*a* of mounting portion 32 is each time arranged such that one sheet size range can be deposited, e.g., a range of from 8"×9" to 8½"×11" in position "F". Thanks to the stiffening rollers 15 and 35 respectively, it is ensured in a manner to be described further below that sheets of all sizes are deposited free from disturbances on sheet stack 28.

A cover 25 is pivotably mounted to a journal 26 and pivotable to its opening position in the direction of the arrow "L" in order to clear the sheet transport path and to give access to collecting bin 33. Moreover a guide element 23, pivotable about a journal 24, is hinged to the inner side of cover 25, such guide element guiding the sheets entering collecting bin 33 onto the upper side of sheet stack 28.

The sheet stacking apparatus according to this invention functions as follows:

Support 14 is shown in position "E" in which collecting bin 33 is adjusted for receiving sheets of, for example, size range B5. This adjustment was effected by the stepping motor 18 which is controlled by known means (not illustrated) from the reproduction device when the sheet size is to be adjusted. A sheet fed out by reproduction device 2 in the direction of the arrow "A" is seized between the endless belts 11 and the pressure rollers 12, deflected downwardly at the directing elements 27 and guided between the counter rollers 16 and 34 and the endless belts 11. In order that the sheets which leave the reproduction device 2 in rapid succession be deposited in collecting bin 33 reliably and in the order in which they arrive, they are guided to a position directly in front of the sheet stack 28 (adjustment of support 14 to the sheet size range concerned, position "E") and stiffened by slight deformation. This is achieved by means of the stiffening rollers 15 and 35 respectively which have a cambering surface and a diameter somewhat greater than that of the counter rollers 16 and 34. Since the stiffening rollers 15 and 35 respectively engage the sheets between the endless belts 11, the sheets are given a slight wave shape and are thus stiffened transversely to the sheet transport direction.

A delivered sheet, thus stiffened, first moves into the collecting bin 33 along a straight path. Since it is guided close to the sheet stack 28 and since it is stiffened, a subsequent sheet cannot come into end-to-end contact with, or pass below a preceding sheet even if the sheets are fed out in rapid succession. This stacking operation is further enhanced by the guide element 23 which in particular reduces the air-cushion effect between the sheets in that it deflects each uppermost sheet downwardly and places it on the upper side of the stack.

When the sheets have left the endless belts 11 they slide into collecting bin 33 down to the abutment 22. On the upper side of the sheet stack a flexible worm-wheel, for example, of a known type (not illustrated) is arranged which by means of friction places the incoming copy sheets reliably in their position at the front limiting element and, moreover, in contact with one of the lateral limiting elements 37. As soon as the predetermined number of sheets has been received in the collecting bin 33, the stapling device (if so provided) is activated which staples the sheet stack 28 in the direction of the arrow "H". Subsequently the abutment 22 moves downwardly in the direction of the arrow "C". As a result, the stapled sheet stack 28 is released and can be transferred in the direction of the arrow "K" from the collecting bin 33 to a position (not illustrated) downstream of the bin.

If a different sheet size is to be handled in reproduction device 2, such as 8"×9", support 14 is adjusted, for example, to position "F". For this purpose stepping motor 18 moves the spindles 13 and 30 via its motor shaft 18*a* and the drive belts 20 and 29. The spindles 13 and 30 shift support 14 upwardly in the direction of the arrow "D" until it has reached the position "F" (shown in dash-dotted lines). Lateral limiting elements 37 are also adjusted by means of a setting device (not illustrated) to the relevant size in that they are moved symmetrically with the sheets which are delivered so that the sheets assume a central position on the support surface 21 of the collecting bin 33. In position "F" of support 14, the deflecting rollers 6 are then situated opposite the counter rollers 16 and the stiffening rollers 15, and collecting bin 33 is adjusted in the sheet transport direction to the larger sheet size.

When the sheets enter the thus enlarged collecting bin 33, they are stacked with the same reliability as above. Due to the fact that the sheets are stiffened in the area of the deflecting rollers 6, they enter the collecting bin 33 free from any interference past the stiffening rollers 35 and the counter rollers 34 respectively which are driven in the same direction of rotation. Moreover, web portions 25*a* arranged between the counter rollers 16 and 34 prevent a sheet from getting between the pairs of rollers 15, 16 and 34, 35 respectively.

If the largest sheet size, namely size B4, is to be handled, support 14 is adjusted in the manner described to, for example, position "G" shown in dash-dotted lines. In position "G", the pairs of rollers 15, 16 and 34, 35 respectively are inoperative with respect to the guiding and stiffening of the sheets. The lateral limiting elements 37 of collecting bin 33 are adjusted in the manner described above to the largest sheet size by the setting device thereof. The sheets of the largest sheet size B4 are guided into collecting bin 33 by means of the endless belts 11 and the counter rollers 12 as well as by means of the directing elements 27 which are situated opposite to the area of the deflecting rollers 6 in position "G". Due to the fact that sheets of this largest size are deposited closely adjacent to the rear limiting element (end wall 32*a*), the incoming sheets cannot interfere with sheets already received in the collecting bin 33 so that disturbances during stacking of the sheets are also prevented in adjustment position "G".

As obvious in particular from adjustment position "G" of support 14, an undisturbed stacking of smaller sheet sizes (e.g., of size B5) would not be possible in the case of this adjustment; that is, an entering sheet would have to bridge too large an area before being placed on sheet stack 28, which would not be feasible because the sheets are not stable enough. However, due to the fact that, in accordance with the invention, the rear limiting element 32, 32*a* of collecting bin 33 is shifted close to the trailing edge of sheet stack 28 for smaller sheet sizes, it is possible in an advantageous manner for the sheets to be deposited on the sheet stack in a reliable and undisturbed manner irrespective of their size.

The generally downwardly inclined arrangement of the sheet stacking apparatus according to this invention is particularly space saving, space being made available in the area of the stationary abutment 22 and above cover 25. With the entrance area of the apparatus described being designed in a suitable manner, the sheets entering in the direction of the arrow "A" can thus be delivered along a guide means 38 shown in dashed lines in the direction of the arrow "J" through the apparatus and subsequently into a downstream processing device such as, for example, a sorter of any known type (not illustrated). Such a step allows the copy sheets delivered in the direction of the arrow "A" to be selectively stacked by means of an adjustable shunt (not illustrated) arranged in the entrance area in either the collecting bin 33 as described or, as mentioned before, delivered in the direction of the arrow "J" to a downstream processing device connected to the reproduction device.

In contrast to the embodiment illustrated in the drawing, the rear limiting element may also be formed directly by the downwardly bent area of the endless belts 11 (i.e., the part of endless belt 11 shown in dashed lines).

Unlike the embodiment illustrated, the whole device may also be arranged such that the support surface 21 of collecting bin 33 is less inclined or is disposed horizontally, and the means arranged in the entrance area and associated with the sheet stacking surface such as endless belts, threaded spindles, etc., assume a position corresponding to the position of the collecting bin 33.

The invention has been described in detail with particular reference to a preferred embodiment thereof, but it will be understood that variations and modifications can be effected within the spirit and scope of the invention as described hereinabove and as defined in the appended claims.

We claim:

1. Apparatus for stacking individual sheets in a collecting bin, said apparatus being adjustable in the entrance direction to different sheet sizes such that a stationary abutment associated with all sheet sizes is provided for the lead sheet edge, as seen in the entrance direction, and an adjustable rear limiting element is associated with a trailing sheet edge, the sheets being stacked in the collecting bin from the edge of said stack which is adjacent to said stationary abutment, said adjustable rear limiting element comprising:

an endless transport belt for transporting sheets into the collecting bin arranged in the entrance area of the collecting bin, said belt extending approximately parallel with the upper side of the stack and being arranged above the maximum stack height in the area where the sheets are fed into the collecting bin;

said transport belt being deflected about a first deflecting roller mounted so as to be adjustable in the entrance direction such that the deflected section of the transport belt forms the adjustable rear limiting element of the collecting bin; and a second deflecting roller adjustable together with the first deflecting roller arranged below the collecting bin so as to face the rear edge of the sheet stack opposite the sheet stack edge adjacent to said stationary abutment.

2. Apparatus according to claim 1 wherein said first deflecting roller and said second deflecting roller are rotatably mounted on a support adjustable in the entrance direction.

3. Apparatus according to claim 1 further including a stationary deflecting roller adjacent to the second adjustable deflecting roller to guide said transport belt in an S-shaped configuration.

4. Apparatus according to claim 1 wherein said transport belt is guided about an adjustable roller and is driven by a stationary driving roller.

5. Apparatus according to claim 2 wherein said support comprises two spaced and rigidly connected guide portions with internal threads, said guide portions being held in engagement with two worm-gear spindles which extend parallel with each other and parallel with the direction of movement of said transport belt.

6. Apparatus according to claim 5 wherein said worm-gear spindles are driven in the same direction by a stepping motor via drive belts.

7. Apparatus according to claim 2 wherein said first movable deflecting roller is mounted on a mounting portion arranged on said support and has a surface facing the collecting bin.

8. Apparatus according to claim 7 wherein a plurality of first spaced deflecting rollers are arranged side-by-side, each deflecting roller associated with a mounting portion.

9. Apparatus according to claim 8 including a plurality of transport belts extending parallel with and at a distance from each other.

10. Apparatus according to claim 9 wherein said support, along with said deflecting rollers, is adjustable to predefined positions associated with sheet size ranges, and stationary and freely rotatable counter rollers and stiffening rollers, located opposite to such positions, are associated therewith.

11. Apparatus according to claim 10 wherein said stiffening rollers have a larger diameter than said counter rollers, and said stiffening rollers are arranged between said transport belts.

12. Apparatus according to claim 10 wherein said pairs of counter rollers and stiffening rollers are coupled by a belt and rotatably mounted on a pivotable cover.

* * * * *